US012529116B2

(12) United States Patent
Mizobata et al.

(10) Patent No.: US 12,529,116 B2
(45) Date of Patent: Jan. 20, 2026

(54) MOLTEN STEEL REFINING METHOD

(71) Applicant: JFE STEEL CORPORATION, Tokyo (JP)

(72) Inventors: Keisuke Mizobata, Tokyo (JP); Akifumi Harada, Tokyo (JP); Yoshie Nakai, Tokyo (JP); Takeshi Murai, Tokyo (JP); Hidemitsu Negishi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 465 days.

(21) Appl. No.: 18/010,103

(22) PCT Filed: Jun. 16, 2021

(86) PCT No.: PCT/JP2021/022858
§ 371 (c)(1),
(2) Date: Dec. 13, 2022

(87) PCT Pub. No.: WO2022/009630
PCT Pub. Date: Jan. 13, 2022

(65) Prior Publication Data

US 2023/0340629 A1 Oct. 26, 2023

(30) Foreign Application Priority Data

Jul. 9, 2020 (JP) ..... 2020-118610

(51) Int. Cl.
*C21C 7/10* (2006.01)

(52) U.S. Cl.
CPC ..... *C21C 7/10* (2013.01)

(58) Field of Classification Search
CPC ..... C21C 7/10; C21C 7/0075; C21C 7/068; C21C 7/072

(Continued)

(56) References Cited

U.S. PATENT DOCUMENTS 6,190,435 B1 2/2001 Miyamoto et al.
6,468,467 B1 10/2002 Miyamoto et al.

FOREIGN PATENT DOCUMENTS

CN 103103315 A 5/2013
CN 105368995 A 3/2016

(Continued)

OTHER PUBLICATIONS

Geng Dian-Qiao et al., Decarburization and Inclusion Removal Process in Single Snorkel Vacuum Degasser, High Temp. Mater. Proc. 36(5): 523-530, Mar. 25, 2017 (Year: 2017).*

(Continued)

*Primary Examiner* — Danielle M. Carda
(74) *Attorney, Agent, or Firm* — Oliff PLC

(57) ABSTRACT

A molten steel refining method that increases a circulating rate using an RH vacuum degassing apparatus is provided. An immersion depth 1 of an immersion tube into molten steel inside a vacuum tank or a circulating gas flow rate G is determined such that a stirring power energy density ε for the molten steel meets the following formulae. (Symbols in the formulae represent the following. G: the circulating gas flow rate, T: a temperature of the molten steel, $\rho_L$: a density of the molten steel, g: a gravitational acceleration, $H_0$: a height from a position of a circulating gas blow-in nozzle to a bath surface of the molten metal inside the vacuum tank in a stationary state, P: a pressure inside the vacuum tank, $P_0$: an atmospheric pressure, $h_V$: a height from the bath surface of the molten steel inside the vacuum tank in the stationary state to a bed, L: a height from a lower end of the immersion tube to the bed, $h_G$: a height from the lower end of the immersion tube to the position of the circulating gas blow-in nozzle, l: the immersion depth of the immersion tube into the molten steel, and $D_U$: an inside diameter of a rising tube.)
$\varepsilon=[371GT\times\ln\{1+(\rho_L g H_0/P)\}]/W_V$, $W_V=(\pi\cdot D_V^2/4)\times H_0\times\rho_L/$ (Continued)

1000, $H_0=h_V+L-h_G$, $h_V=(P_0-P)/(\rho_L g)+1-L$, $1.35\times10^5\times D_U/W_V<\varepsilon<2.1\times10^4$.

2 Claims, 6 Drawing Sheets

(58) Field of Classification Search
USPC ..... 75/508
See application file for complete search history.

(56) References Cited

FOREIGN PATENT DOCUMENTS

| | | | | |
|---|---|---|---|---|
| CN | 105755192 | A | | 7/2016 |
| CN | 107254560 | A | | 10/2017 |
| EP | 0 881 304 | A1 | | 12/1998 |
| JP | H02-173205 | A | | 7/1990 |
| JP | H04-272120 | A | | 9/1992 |
| JP | H08-269534 | A | | 10/1996 |
| JP | 2004-156083 | A | | 6/2004 |
| JP | 2007-031820 | A | | 2/2007 |
| JP | 2018-104764 | A | | 7/2018 |
| JP | 2018-127683 | A | | 8/2018 |
| JP | 2020-2425 | A | | 1/2020 |
| JP | 2020180341 | A | * | 11/2020 |
| KR | 20030040967 | A | | 5/2003 |
| KR | 10-2014-0060877 | A | | 5/2014 |

OTHER PUBLICATIONS

JP2020180341A Translation (Year: 2020).*

Van Ende, A Kinetic Model for the Ruhrstahl Heraeus (RH) Degassing Process, Metallurgical and Materials Transactions B, vol. 42B, Jun. 2011 (Year: 2011).*

Tanaka et al. "Nitrogen adjustment in molten steel using RH vacuum degasser," La Metallurgia Italiana, No. 3 (Year: 2019).*

Kuwahara et al.; "Measurement and estimation for Circulating Rate in RH;" Tetsu-to-Hagane; 1987; 1pp.; vol. 73.

Kuwabara et al.; "Investigation of Decarburization Behavior in RH-reactor and its Operation Improvement;" Transactions ISIJ; 1988; pp. 305-314; vol. 28.

Nakamura et al.; "Numerical Simulation of Gas-liquid Circulation Flow of RH;" Tetsuo-to-Hagane; 2015; pp. 123-128; vol. 101, No. 2.

Sep. 14, 2021 Office Action issued in Japanese Patent Application No. 2021-545886.

Jul. 13, 2021 Search Report issued in International Patent Application No. PCT/JP2021/022858.

Van Ende, M. et al., "A Kinetic Model for the Ruhrstahl Heraeus (RH) Degassing Process," Metallurgical and Materials Transactions B, vol. 42B, Jun. 2011, pp. 477-489.

May 8, 2024 extended Search Report issued in European Patent Application No. 21836922.1.

Feb. 22, 2025 Office Action issued in Chinese Patent Application No. 202180047927.9.

Marie-Aline Van Ende et al., "A Kinetic Model for the Ruhrstahl Heraeus (RH) Degassing Process", Metallurgical and Materials Transactions B, vol. 42, Jun. 2011, pp. 477-489.

Feb. 14, 2024 Decision to Grant issued in Korean Patent Application No. 10-2022-7042644.

Jan. 10, 2024 Office Action issued in Chinese Patent Application No. 202180033998.3.

* cited by examiner

MOLTEN STEEL REFINING METHOD

TECHNICAL FIELD

The present invention relates to a molten steel refining method using an RH vacuum degassing apparatus.

BACKGROUND ART

Various types of means for performing ladle refining and vacuum degassing of molten steel are known, including VOD and VTD. With steel materials becoming upscale and the demand for them increasing, the variety and quantity of steel requiring vacuum degassing are on an increasing trend. This situation makes it highly desirable to enhance the degassing capacity by shortening the time taken for the treatment and to reduce the manufacturing costs of iron and steel by lowering the converter temperature. Out of such needs, vacuum degassing is often performed using a Rheinstahl-Heraeus (RH) vacuum degassing apparatus.

As shown in FIG. 1, an RH vacuum degassing apparatus 1 has a rising-side immersion tube 8 and a descending-side immersion tube 9. These rising-side immersion tube 8 and descending-side immersion tube 9 are immersed into molten steel 3 inside a ladle 2, and the inside of a degassing vacuum tank 5 is depressurized by discharging air from a discharge port through a duct 11 by a depressurization device (not shown) to thereby suck up the molten steel 3. Then, a circulating gas is blown into the rising-side immersion tube 8 including a circulating gas blow-in pipe 10 through this circulating gas blow-in pipe 10. As the circulating gas, an inert gas, such as an argon gas, is often used. The molten steel 3 is moved upward using the gas buoyancy and led to the degassing vacuum tank 5, and is then moved downward through the descending-side immersion tube 9. Thus, the molten steel 3 is circulated and degassed.

Examples of refining using such an RH vacuum degassing apparatus include decarburization under vacuum (hereinafter referred to as "vacuum decarburization") and degassing of hydrogen, nitrogen, etc. Increasing the circulating rate is effective for accelerating the decarburization speed in vacuum decarburization or the degassing speed in degassing, and many methods for increasing the circulating rate have been proposed.

For example, Patent Literature 1 proposes a method in which an inert gas having been heated to 200° C. to 1000° C. is blown in at a pressure of 0.5 MPa or higher to circulate molten steel.

Patent Literature 2 proposes a method in which a degassing tank is extended downward to provide an outer immersion tube opening downward, and inside this outer immersion tube, an inner immersion tube opening upward and downward is concentrically disposed to serve as a rising flow passage through which molten steel rises as an argon gas is blown in from a circulating gas blow-in nozzle provided in the inner immersion tube, while the gap between the inner immersion tube and the outer immersion tube serves as a descending flow passage for the molten steel. Thus, the rising flow passage and the descending flow passage with large cross-sectional areas are formed to thereby increase the circulating rate of the molten steel.

In general, the circulating rate in a degassing apparatus is calculated by the following Formula (A) disclosed in Non Patent Literature 1:

$$Qc=K\times G^{1/3}\times D^{4/3}\times\{\ln(P_0/P)\}^{1/3}/(\rho_1/1000) \quad (A)$$

where, Qc: calculated molten steel circulating rate (molten steel $m^3$/min), G: circulating gas flow rate ($Nm^3$/sec), D: inside diameter (m) of immersion tube, P: pressure (Pa) inside vacuum tank, $P_0$: atmospheric pressure (101325 Pa), and $\rho_1$: density ($kg/m^3$) of molten steel.

K is a fitting parameter that is obtained from results of experiments under various operation conditions, and Non Patent Literature 2 reports that K is approximately 446.3 under molten steel conditions. In Formula (A), the power index of the inside diameter D of the immersion tube is higher than that of the circulating gas flow rate G. This indicates that, to increase the calculated molten steel circulating Qc, increasing the inside diameter of the immersion tube is more effective than increasing the circulating gas flow rate. It is generally known that increasing the inside diameter of the immersion tube and thereby increasing the circulating rate of molten steel is effective as means for enhancing the efficiency of the degassing reaction.

Here, the inside diameter of the immersion tube is restricted by the size of the degassing tank, so that increasing the inside diameter of the immersion tube in most cases requires expanding the degassing gas tank at the same time. However, the dimensions of the degassing tank are restricted by the size of ladle and ancillary facilities. Therefore, when it is difficult for facility reasons to evenly expand the degassing tank while keeping its exact circular shape, a technique is used such as forming the degassing tank in an elliptic shape by expanding it only in the circulation direction, i.e., the direction from the rising tube toward the descending tube, and expanding the immersion tube so as to correspond to the expansion in a long-axis direction of the elliptic shape.

Patent Literature 3 proposes a structure of a degassing tank that is elliptic in lateral cross-section and has a pair of circulation tubes arranged in a long-axis direction. According to this literature, performing vacuum refining using a degassing tank adopting this technique can eliminate a stagnant part in a molten steel flow inside the vacuum degassing tank and thereby preclude the standstill of molten steel and the retention of slag, so that the decarburization speed increases.

Patent Literature 4 proposes a method that fines air bubbles of an inert gas by providing an ultrasonic vibrator on an inner circumferential surface of a rising-side immersion tube, above an installation position of a circulating gas blow-in pipe provided in the rising-side immersion tube.

CITATION LIST

Patent Literature

Patent Literature 1: JP2007-031820A
Patent Literature 2: JPH08-269534A
Patent Literature 3: JPH04-272120A
Patent Literature 4: JPH02-173205A

Non Patent Literature

Non Patent Literature 1: Tatsuro Kuwabara et al., Tetsu-to-Hagane, Vol. 73 (1987), PS176
Non Patent Literature 2: Tatsuro Kuwabara et al., Transactions of The Iron and Steel Institute of Japan, Vol. 28 (1988), P305

SUMMARY OF INVENTION

Technical Problem

However, the above-described related arts have the following problems.

The method disclosed in Patent Literature 1 has a problem in that it needs equipment for preheating an inert gas and thereby causes an increase in the treatment cost.

The method disclosed in Patent Literature 2 has a problem in that, as it needs the outer immersion tube and the inner immersion tube, the device becomes complicated. Moreover, the circulating gas pipe needs to be passed to the inner immersion tube via the degassing tank, which makes it impossible to replace only the inner immersion tube by removing it from the degassing tank. Thus, replacing the immersion tube requires replacing the whole lower degassing tank, so that the refractory cost increases significantly.

The technique disclosed in Patent Literature 3 has a problem in that it takes considerable time and money to introduce, as forming a degassing tank into an elliptic structure requires newly producing an iron shell of the degassing tank.

The method disclosed in Patent Literature 4 needs the ultrasonic vibrator, an ultrasonic wave transmitter, etc., so that not only does the device become complicated but also an increase in the device cost and the immersion tube cost is unavoidable.

Having been contrived in view of these circumstances, the present invention aims to propose a molten steel refining method that can increase the circulating rate when refining molten steel using an RH vacuum degassing apparatus, without requiring new facility investment or causing an increase in the treatment cost.

Solution to Problem

To solve the above problems, the present inventors conducted various experiments with attention focused on the influence of operation conditions and the shape of an RH vacuum degassing apparatus on a flow inside a degassing tank. As a result, we found that the energy of a circulating gas blown into a rising tube was dissipated mainly inside a vacuum tank bath, and that changing the operation conditions so as to reduce the amount of energy dissipated could increase the circulating rate. The present invention has been contrived based on this finding, and the gist thereof is as follows.

A molten steel refining method of the present invention that advantageously solves the above problems is a molten steel refining method using an RH vacuum degassing apparatus, characterized in that an immersion depth l of an immersion tube into molten steel inside a vacuum tank or a circulating gas flow rate G is determined such that a stirring power energy density ε for the molten steel expressed by the following Formulae (1) to (4) meets the following Formula (5). (Symbols in the formulae represent the following.: the stirring power energy density (watt/ton) for the molten steel inside the vacuum tank, G: the circulating gas flow rate ($Nm^3$/sec), T: a temperature (K) of the molten steel, $\rho_L$: a density ($kg/m^3$) of the molten steel, g: a gravitational acceleration (9.8 m/$sec^2$), $W_V$: a mass (ton) of the molten steel inside the vacuum tank, $D_V$: an inside diameter (m) of the vacuum tank, $H_0$: a height (m) from a position of a circulating gas blow-in nozzle to a bath surface of the molten steel inside the vacuum tank in a stationary state, P: a pressure (Pa) inside the vacuum tank, $P_0$: an atmospheric pressure (101325 Pa), $h_V$: a height (m) from the bath surface of the molten steel inside the vacuum tank in the stationary state to a bed, L: a height (m) from a lower end of the immersion tube to the bed, $h_G$: a height (m) from the lower end of the immersion tube to the position of the circulating gas blow-in nozzle, l: the immersion depth (m) of the immersion tube into the molten steel, and $D_U$: an inside diameter (m) of a rising tube.)

$$\varepsilon=[371GT\times\ln\{1+(\rho_L gH_0/P)\}]/W_V \quad (1)$$

$$W_V=(\pi\cdot D_V^2/4)\times h_V\times\rho_L/1000 \quad (2)$$

$$H_0=h_V+L-h_G \quad (3)$$

$$h_V=(P_0-P)/(\rho_L g)+1-L \quad (4)$$

$$1.35\times10^5\times D_U/W_V<\varepsilon<2.1\times10^4 \quad (5)$$

The molten steel refining method according to the present invention could be a more preferable solution when the immersion depth l of the immersion tube into the molten steel or the circulating gas flow rate G is determined such that the stirring power energy density ε meets the following Formula (6):

$$1.35\times10^5\times D_U/W_V<\varepsilon<1.0\times10^4 \quad (6)$$

Advantageous Effects of Invention

The present invention can increase the circulating rate and contributes to shortening the treatment time when refining molten steel using an RH vacuum degassing apparatus, without requiring new facility investment or causing an increase in the treatment cost.

DESCRIPTION OF EMBODIMENT

Figure 1:
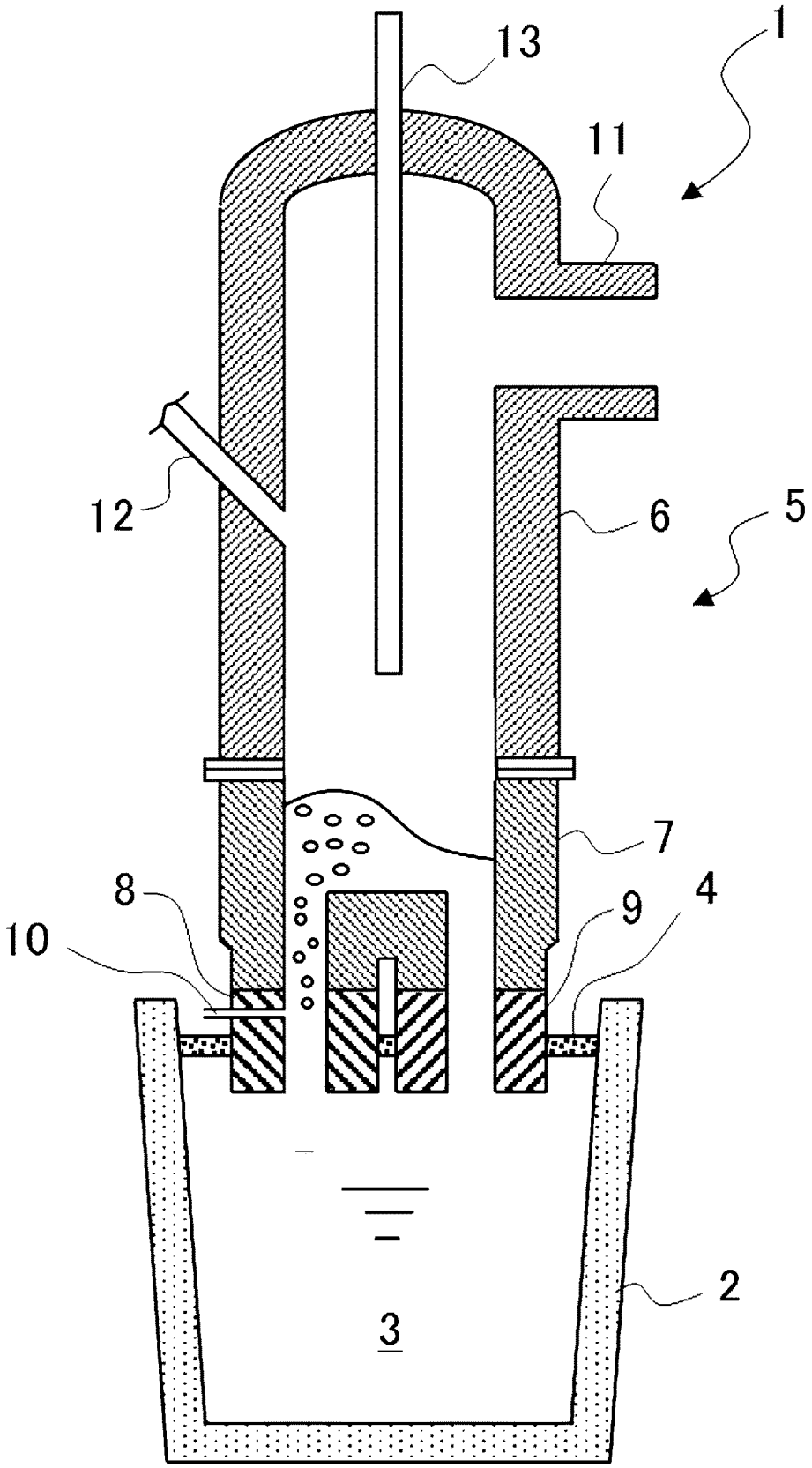
FIG. 1 is a schematic vertical sectional view showing one example of an RH vacuum degassing apparatus.

Before the present invention is described below based on a preferred embodiment, first, a result of a study that led to the present invention will be described. FIG. 1 is a schematic vertical sectional view showing one example of an RH vacuum degassing apparatus used for a molten steel refining method as one embodiment of the present invention.

In FIG. 1, reference sign 1 is an RH vacuum degassing apparatus; 2 is a ladle; 3 is molten steel; 4 is slag; 5 is a vacuum tank; 6 is an upper tank; 7 is a lower tank; 8 is a rising-side immersion tube (rising tube); 9 is a descending-side immersion tube (descending tube); 10 is a circulating gas blow-in pipe; 11 is a duct; 12 is a raw material charging port; and 13 is a top-blowing lance. The vacuum tank 5 is composed of the upper tank 6 and the lower tank 7. The top-blowing lance 13 is a device through which an oxygen gas or a solvent is blown to be added to the molten steel inside the vacuum tank, and is installed at an upper part of the vacuum tank 5 while being able to move up and down inside the vacuum tank 5.

In the RH vacuum degassing apparatus 1, the ladle 2 containing the molten steel 3 is raised by a raising-lowering device (not shown), and the rising-side immersion tube 8 and the descending-side immersion tube 9 are immersed into the molten steel 3 inside the ladle. Then, air inside the vacuum tank 5 is discharged by an exhaust device (not shown) coupled to the duct 11 to depressurize the inside of the vacuum tank 5, and a circulating gas is blown into the rising-side immersion tube 8 through the circulating gas blow-in pipe 10. When the inside of the vacuum tank 5 is depressurized, the molten steel 3 inside the ladle rises in proportion to the difference between an atmospheric pressure and a pressure (a degree of vacuum) inside the vacuum tank and flows into the vacuum tank. At the same time, due to a gas lifting effect of the circulating gas blown in through the circulating gas blow-in pipe 10, the molten steel 3 rises through the rising-side immersion tube 8 along with the circulating gas and flows into the vacuum tank 5. Thereafter, the molten steel 3 forms a flow that returns to the ladle 2 via the descending-side immersion tube 9, or a so-called circulating flow, and thus undergoes refining by RH vacuum degassing. As the molten steel 3 is exposed to a depressurized atmosphere inside the vacuum tank, gas components in the molten steel move to the atmosphere inside the vacuum tank and a degassing reaction of the molten steel 3 progresses.

In a water model experiment simulating an RH vacuum degassing apparatus, we studied about increasing the circulating rate of molten steel by making various changes to operation conditions. Here, a water model was used for the following reason. Molten steel is heavy and highly viscous compared with water, while molten steel and water have almost the same kinetic viscosity. Therefore, when simulation is conducted on a full scale (scale ratio 1.0) using water, two dimensionless numbers, a Froude number and a Reynolds number, can be matched with those of molten steel. Thus, in a full-scale simulation method using water, a flow of molten steel can be reproduced in terms of the influence of the gravity, inertial force, and viscous force. As a result, we found that the circulating rate could be efficiently increased by controlling the energy density ε of power with which the circulating gas blown into the rising tube stirred the fluid inside the vacuum tank to be within an appropriate range.

The stirring power energy density ε for the molten steel inside the vacuum tank is represented by the following Formulae (1) to (4):

$$\varepsilon=[371GT\times\ln\{1+(\rho_L gH_0/P)\}]/W_V \quad (1)$$

$$W_V=(\pi\cdot D_V^2/4)\times h_V\times\rho_L/1000 \quad (2)$$

$$H_0=h_V+L-h_G \quad (3)$$

$$h_V=(P_0-P)/(\rho_L g)+1-L \quad (4)$$

where the symbols represent the following:

- ε: the stirring power energy density (watt/ton) for the molten steel inside the vacuum tank,
- G: the circulating gas flow rate ($Nm^3$/sec),
- T: the temperature (K) of the molten steel,
- $\rho_L$: the density (kg/$m^3$) of the molten steel,
- g: the gravitational acceleration (9.8 m/$sec^2$),
- $W_V$: the mass (ton) of the molten steel inside the vacuum tank,
- $D_V$: the inside diameter (m) of the vacuum tank,
- $H_0$: the height (m) from the position of a circulating gas blow-in nozzle to the bath surface of the molten steel inside the vacuum tank in the stationary state,
- P: the pressure (Pa) inside the vacuum tank,
- $P_0$: the atmospheric pressure (101325 Pa),
- $h_V$: the height (m) from the bath surface of the molten steel inside the vacuum tank in the stationary state to a bed,
- L: the height (m) from the lower end of the immersion tube to the bed,
- $h_G$: the height (m) from the lower end of the immersion tube to the position of the circulating gas blow-in nozzle, and
- l: the immersion depth (m) of the immersion tube into the molten steel.

Figure 2:
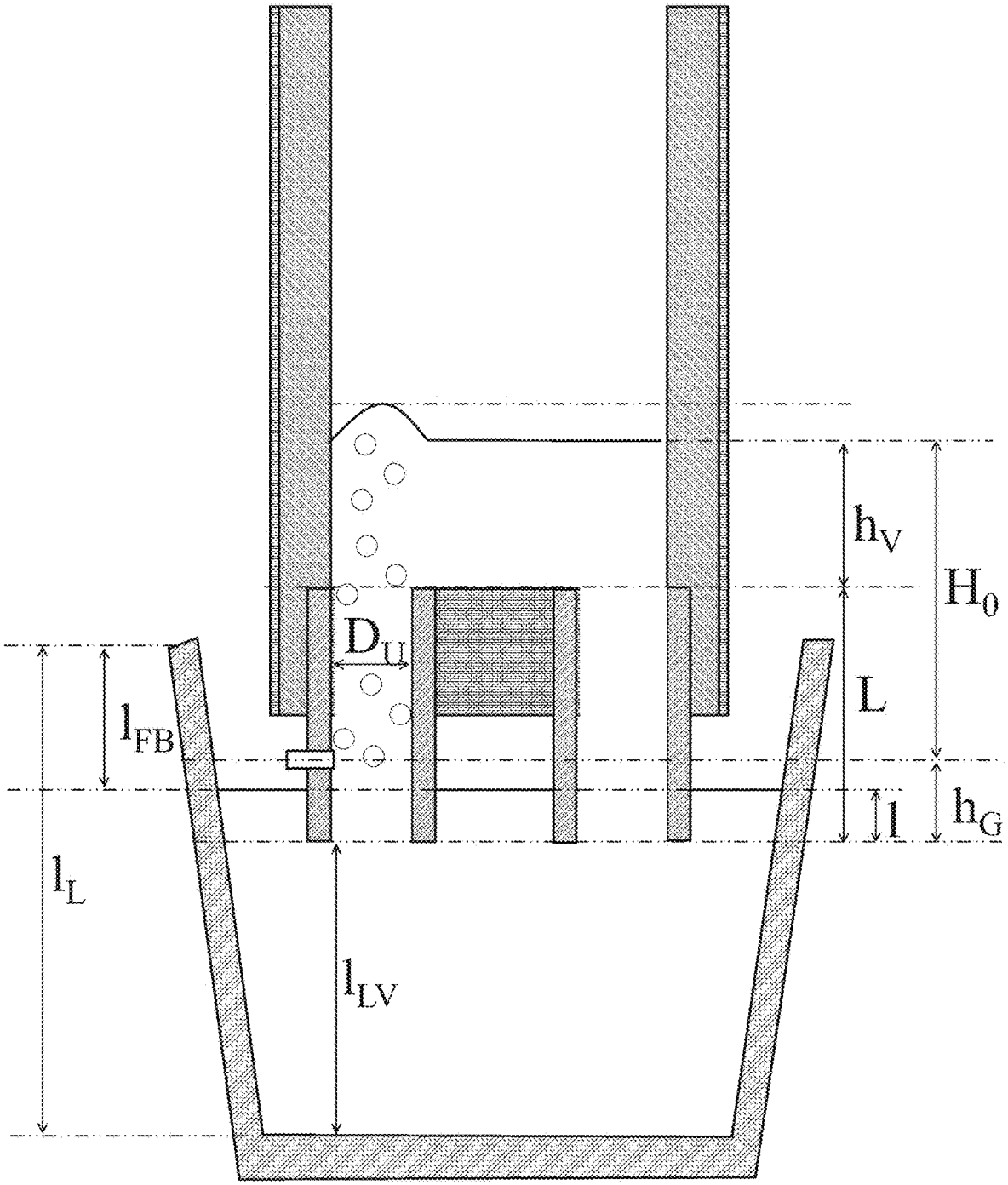
FIG. 2 is an enlarged sectional view of the RH vacuum degassing apparatus showing a concept of the present invention.

FIG. 2 is an enlarged sectional view of the RH vacuum degassing apparatus representing the concept of the present invention. In FIG. 2, the symbols relating to the dimensions of the RH vacuum degassing apparatus used in the above Formulae (1) to (4) are indicated.

In Formula (4), the immersion depth l of the immersion tube into the molten steel is defined by the following Formula (B):

$$l=l_L-l_{FB}-l_{LV} \quad (B)$$

where, $l_L$: the distance (m) from the upper end of the ladle to the bottom of the ladle,

- $l_{FB}$: the distance (m) from the upper end of the ladle to the surface of the molten steel inside the ladle, and
- $l_{LV}$: the distance (m) from the lower end of the immersion tube to the bottom of the ladle.

$l_{FB}$ is obtained, for example, by measuring the surface level of the molten steel using a molten steel level meter, or by immersing a metal rod into the molten steel inside the ladle and measuring the length of a melted portion. $l_{LV}$ is obtained from the relative distance between the ladle and the vacuum tank that is acquired from a control system.

Figure 3:
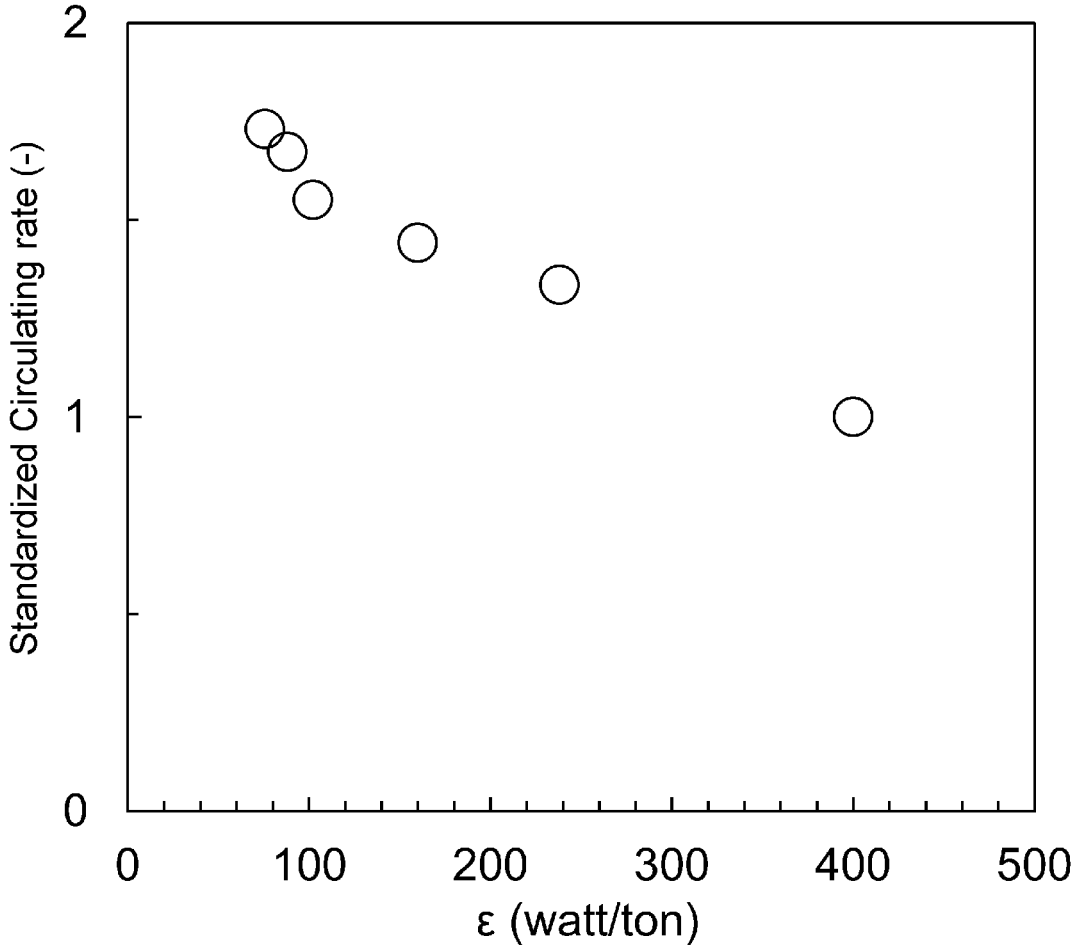
FIG. 3 is a graph showing a relationship of a standardized circulating rate with a stirring power energy density ε for a fluid inside a vacuum tank in a water model experiment.

In the water model experiment, the depth of water bath inside the vacuum tank was changed to various depths and the circulating rates at the respective water levels were obtained by measuring the flow velocity in the descending tube. FIG. 3 shows a relationship of a standardized circulating rate with the stirring power energy density ε for the fluid inside the vacuum tank in the water model experiment. The standardized circulating rate is a ratio relative to a value at which the circulating rate is lowest. As a result of the experiment, we found that when the circulating gas flow rate was constant, the circulating rate increased as the stirring power energy density ε for the fluid inside the vacuum tank decreased.

The reason why the circulating rate varies as described above is as follows: when the stirring power energy density ε for the molten steel inside the vacuum tank is lower, there is less stirring of the bath surface and the ratio of energy consumed as energy that fluctuates the boundary of the molten steel becomes lower, so that the ratio of a part of the energy of the circulating gas that contributes to circulation increases proportionally and thus the circulating rate increases.

Even when the stirring power energy density ε for the molten steel inside the vacuum tank is sufficiently low, if stirring power energy E (watt) expressed by the following Formula (C) is low relative to the inside diameter $D_U$ (m) of the rising tube, a lifting and pumping effect is not sufficiently exhibited and the circulating rate decreases.

$$E=[371GT\times\ln\{1+(\rho_L gH_0/P)\}](=\varepsilon\cdot W_V) \quad (C)$$

Figure 4:
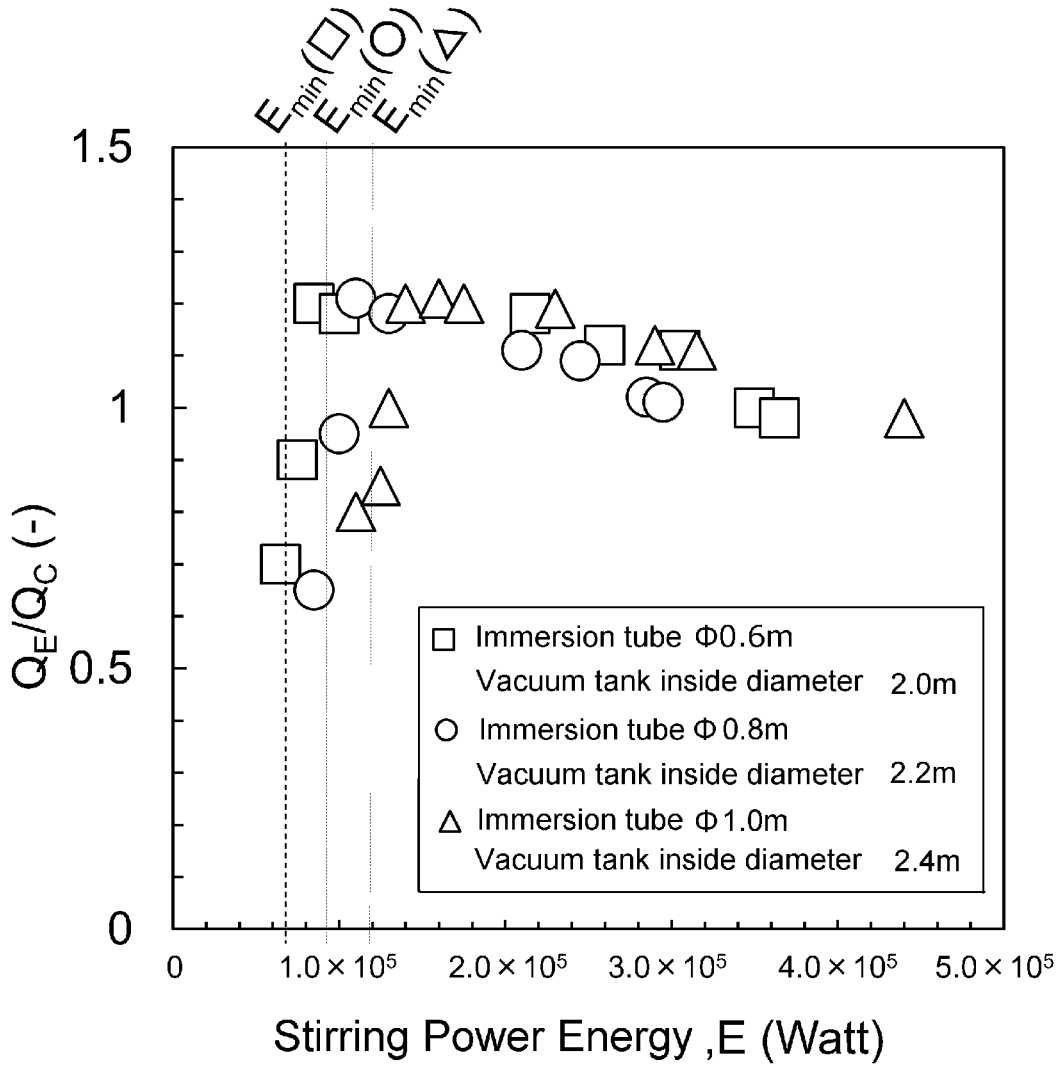
FIG. 4 is a graph showing a relationship between stirring power energy E and $Q_E/Q_C$ that is a ratio of an actually measured molten steel circulating rate $Q_E$ to a calculated molten steel circulating rate $Q_C$ obtained using Formula (A) in RH vacuum degassing apparatuses varying in an immersion tube diameter and a vacuum tank inside diameter.
Figure 5:
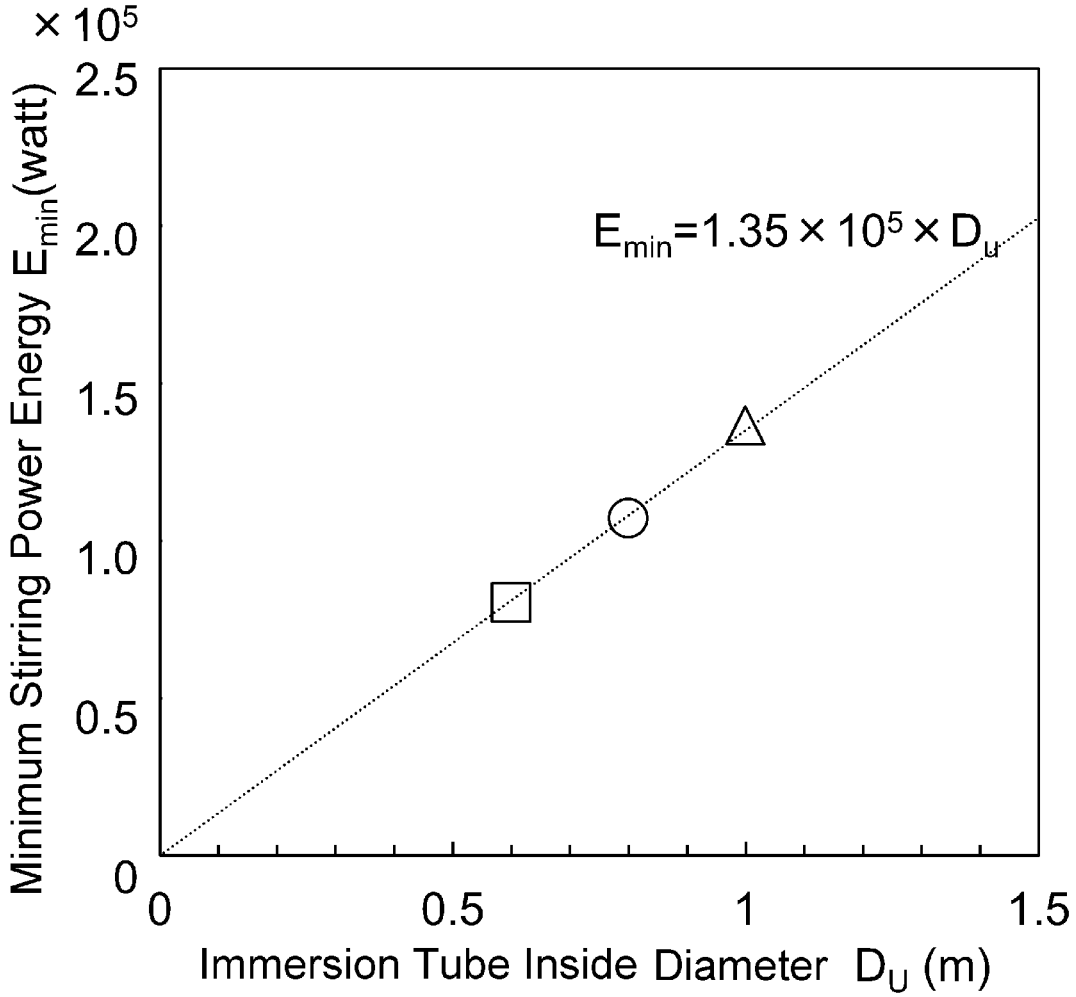
FIG. 5 is a graph showing a relationship between a rising tube diameter $D_U$ and minimum stirring power energy $E_{min}$.

FIG. 4 shows a relationship between the stirring power energy E and $Q_E/Q_C$ that is a ratio of the actually measured molten steel circulating rate $Q_E$ (molten steel $m^3$/min) to the calculated molten steel circulating rate $Q_C$ obtained using Formula (A) in RH vacuum degassing apparatuses varying in an immersion tube diameter and a vacuum tank inside diameter. For the actually measured molten steel circulating rate $Q_E$, copper was added as a tracer from the vacuum tank during treatment and a homogeneous mixing time τ (sec) was measured, and the rate $Q_E$ was calculated from the obtained homogeneous mixing time τ using a relational expression to be described later. Formula (A) was calculated with the constant K set to 446.3. When the stirring power energy E is within a range equal to or higher than a certain value, as the stirring power energy E decreases, the stirring power energy density ε for the molten steel inside the vacuum tank also decreases, so that the energy efficiency increases and the circulating rate increases. On the other hand, when the stirring power energy E is equal to or lower than a certain value $E_{min}$, the lifting and pumping effect of the gas falls short relative to the rising tube diameter $D_U$, which leads to poor circulation and a decrease in $Q_E/Q_C$. Here, FIG. 5 shows a relationship between the rising tube diameter $D_U$ and $E_{min}$, with $E_{min}$ defined as the minimum stirring power energy. From a proportional constant in proportional approximation of the relationship between the rising tube diameter $D_U$ and $E_{min}$ obtained from the relationship of FIG. 5, a condition for the stirring power energy E required for normal circulation in the RH vacuum degassing apparatus was defined as expressed by the following Formula (7):

$$1.35\times10^5\times D_U\leq E \quad (7)$$

Using the relationship $\varepsilon=E/W_V$, Formula (7) is transformed into the following Formula (8):

$$1.35\times10^5\times D_U/W_V<\varepsilon \quad (8)$$

Figure 6:
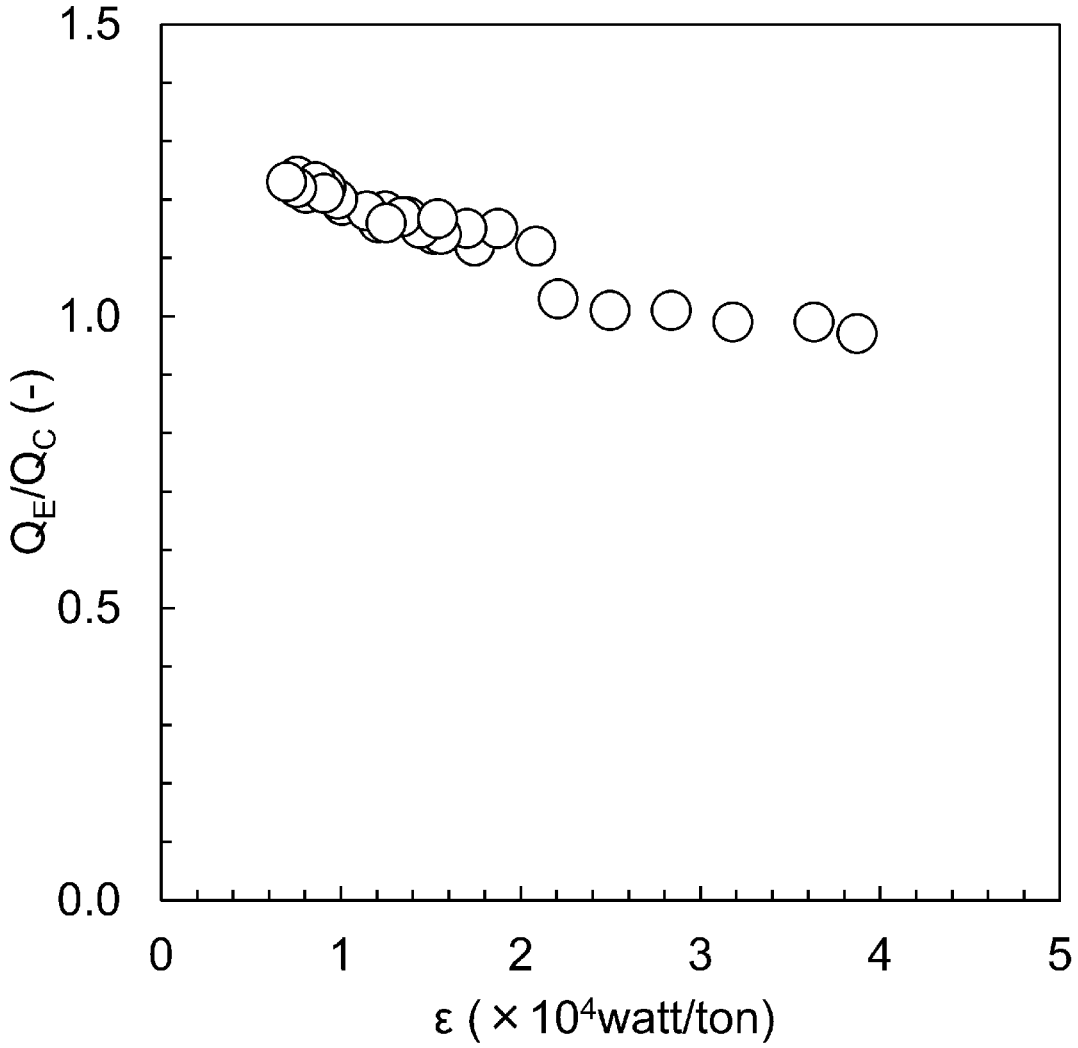
FIG. 6 is a graph showing a relationship of the ratio $Q_E/Q_C$ between the calculated molten steel circulating rate $Q_C$ and the actually measured molten steel circulating rate $Q_E$ with the stirring power energy density ε for molten steel inside a vacuum tank in actual operation.

Further, as a result of measuring the circulating rates under various conditions and evaluating $Q_E/Q_C$ for the same RH vacuum degassing apparatus, we found that when the stirring power energy density ε for the molten steel inside the vacuum tank was lower than $2.1\times10^4$, $Q_E/Q_C$ increased greatly and exceeded 1.1. FIG. 6 shows the relationship between the stirring power energy density ε for the molten steel inside the vacuum tank and $Q_E/Q_C$. In FIG. 6, those conditions that do not meet Formula (8) are omitted.

From this result, Formula (9) is obtained as a condition for ε that increases the circulating rate:

$$\varepsilon<2.1\times10^4 \quad (9)$$

From Formula (8) and Formula (9), Formula (5) is obtained as a condition for the stirring power energy density ε required to increase the energy efficiency of the circulating gas and increase the circulating rate:

$$1.35\times10^5\times D_U/W_V<\varepsilon<2.1\times10^4 \quad (5)$$

When the stirring power energy density ε for the molten steel inside the vacuum tank is further decreased within a range that meets Formula (7), $Q_E/Q_C$ increases further, and when ε is in a range lower than $1.0\times10^4$, this ratio exceeds 1.2. Therefore, setting the value of ε to be lower than $1.0\times10^4$ is more desirable. These conditions are expressed by a formula as by Formula (6):

$$1.35\times10^5\times D_U/W_V<\varepsilon<1.0\times10^4 \quad (6)$$

Parameters for controlling the stirring power energy density ε inside the vacuum tank to be within the range of Formula (5) or Formula (6) are the circulating gas flow rate G, the degree of vacuum P, and the immersion depth l of the immersion tube into the molten steel, other than the dimensions of the apparatus. When the degree of vacuum is degraded, the reaction speed of degassing that is the original purpose decreases or becomes zero. Therefore, it is desirable to perform control by changing the circulating gas flow rate G or the immersion depth l of the immersion tube into the molten steel.

As has been described above, the present invention can increase the circulating rate of molten steel without requiring new equipment investment or causing an increase in the treatment cost.

EXAMPLES

Vacuum refining of 300 tons of molten steel that had been blown by a converter was performed using an RH vacuum degassing apparatus. In this case, ε was calculated by Formulae (1) to (4) from the dimensions of the apparatus and operation conditions, and the immersion depth l of the immersion tube into the molten steel was adjusted within a range of 0.3 m to 0.9 m so as to meet Formula (5) or Formula (6). As the degassing tank, a degassing tank (tank A) having the vacuum tank cross-sectional area $S_A$ of 3.14 $m^2$ and the rising tube inside diameter $D_U$ of 0.6 m, or the degassing tank (tank B) having a vacuum tank cross-sectional area $S_A$ of 3.8 $m^2$ and the rising tube inside diameter $D_U$ of 0.8 m was used. As for the operation conditions, the degree of vacuum P was 133 Pa, and the circulating gas flow rate G was held constant at the flow rate of one of 0.020 $Nm^3$/sec, 0.027 $Nm^3$/sec, 0.037 $Nm^3$/sec, and 0.050 $Nm^3$/sec during treatment. Copper was added as a tracer from the vacuum tank into a circulating flow, and a homogeneous mixing time τ (sec) was measured and the actually measured molten steel circulating rate $Q_E$ was calculated from the obtained homogeneous mixing time τ. The relationship between the homogeneous mixing time τ and the actually measured molten steel circulating rate $Q_E$ is expressed by the following Formulae (D), (E), and (F):

$$\tau=800\times\varepsilon^{-0.45} \quad (D)$$

$$\varepsilon_L=8.33\times10^{-3}\times\rho Q_E v^2/W_L \quad (E)$$

$$v=Q_E/(15\pi D^2) \quad (F)$$

where, $\varepsilon_L$ is the stirring power density (watt/ton) for the molten steel in the ladle, v is the flow velocity (m/sec) of the molten steel in the descending tube, and $W_L$ is the amount (ton) of the molten steel in the ladle.

Further, the calculated molten steel circulating rate $Q_C$ was obtained using Formula (A), and $Q_E/Q_C$ was calculated for each charge. The constant K in Formula (A) was set to 446.3. The molten steel used had an element composition with C: 0.04 to 0.06 mass %, Si: 0.05 mass % or less, Mn: 0.3 mass % or less, P: 0.02 mass % or less, and S: 0.003 mass % or less, and the temperature of the molten steel before treatment was 1640 to 1670° C.

The result of the experiment is shown in Table 1. Within a range that meets Formula (5), the ratio of the actually measured molten steel circulating rate $Q_E$ to the calculated molten steel circulating rate $Q_C$ is equal to or higher than 1.1, regardless of differences in various operation conditions and the dimensions of the apparatus, which is a good result. Moreover, within a range that meets Formula (6), compared with when only Formula (5) is met, the circulating rate is further increased and $Q_E/Q_C$ is stably equal to or higher than 1.2, which is an even better result.

The invention claimed is:

1. A molten steel refining method using an RH vacuum degassing apparatus, wherein an immersion depth l of an immersion tube into molten steel inside a vacuum tank or a circulating gas flow rate G is determined such that a stirring power energy density ε for the molten steel expressed by the following Formulae (1) to (4) meets the following Formula (5):

$$\varepsilon=[371GT\times\ln\{1+(\rho_L gH_0/P)\}]/W_V \quad (1)$$

$$W_V=(\pi\cdot D_V^2/4)\times h_V\times\rho_L/1000 \quad (2)$$

| No. | G Nm³/sec | $S_A$ m² | L m | $h_G$ m | l m | $H_0$ m | $h_V$ m | $D_U$ m | V m³ | E watt | ε watt/ton | $Q_E/Q_C$ — | Remarks |
|---|---|---|---|---|---|---|---|---|---|---|---|---|---|
| 1 | 0.027 | 3.14 | 1.60 | 0.30 | 0.40 | 1.57 | 0.27 | 0.60 | 0.86 | 124728 | 20548 | 1.12 | Inventive Example |
| 2 | 0.027 | 3.14 | 1.60 | 0.30 | 0.45 | 1.62 | 0.32 | 0.60 | 1.02 | 126364 | 17466 | 1.14 | Inventive Example |
| 3 | 0.027 | 3.14 | 1.60 | 0.30 | 0.60 | 1.77 | 0.47 | 0.60 | 1.49 | 127380 | 12104 | 1.16 | Inventive Example |
| 4 | 0.027 | 3.14 | 1.60 | 0.30 | 0.70 | 1.87 | 0.57 | 0.60 | 1.81 | 128343 | 10078 | 1.19 | Inventive Example |
| 5 | 0.027 | 3.14 | 1.60 | 0.30 | 0.80 | 1.97 | 0.67 | 0.60 | 2.12 | 128806 | 8649 | 1.22 | Inventive Example |
| 6 | 0.027 | 3.14 | 1.60 | 0.30 | 0.85 | 2.02 | 0.72 | 0.60 | 2.28 | 129258 | 8082 | 1.21 | Inventive Example |
| 7 | 0.027 | 3.14 | 1.60 | 0.30 | 0.90 | 2.07 | 0.77 | 0.60 | 2.43 | 171501 | 7587 | 1.24 | Inventive Example |
| 8 | 0.037 | 3.80 | 1.60 | 0.30 | 0.45 | 1.62 | 0.32 | 0.80 | 1.23 | 173023 | 19847 | 1.15 | Inventive Example |
| 9 | 0.037 | 3.80 | 1.60 | 0.30 | 0.55 | 1.72 | 0.42 | 0.80 | 1.61 | 173751 | 15309 | 1.17 | Inventive Example |
| 10 | 0.037 | 3.80 | 1.60 | 0.30 | 0.60 | 1.77 | 0.47 | 0.80 | 1.80 | 175147 | 13754 | 1.18 | Inventive Example |
| 11 | 0.037 | 3.80 | 1.60 | 0.30 | 0.70 | 1.87 | 0.57 | 0.80 | 2.18 | 176471 | 11453 | 1.18 | Inventive Example |
| 12 | 0.037 | 3.80 | 1.60 | 0.30 | 0.80 | 1.97 | 0.67 | 0.80 | 2.56 | 177109 | 9829 | 1.20 | Inventive Example |
| 13 | 0.037 | 3.80 | 1.60 | 0.30 | 0.85 | 2.02 | 0.72 | 0.80 | 2.75 | 177730 | 9184 | 1.22 | Inventive Example |
| 14 | 0.037 | 3.80 | 1.60 | 0.30 | 0.90 | 2.07 | 0.77 | 0.80 | 2.95 | 235940 | 8621 | 1.23 | Inventive Example |
| 15 | 0.050 | 3.80 | 1.60 | 0.30 | 0.55 | 1.72 | 0.42 | 0.80 | 1.61 | 236933 | 20876 | 1.12 | Inventive Example |
| 16 | 0.050 | 3.80 | 1.60 | 0.30 | 0.60 | 1.77 | 0.47 | 0.80 | 1.80 | 237898 | 18756 | 1.15 | Inventive Example |
| 17 | 0.050 | 3.80 | 1.60 | 0.30 | 0.65 | 1.82 | 0.52 | 0.80 | 1.99 | 238837 | 17038 | 1.15 | Inventive Example |
| 18 | 0.050 | 3.80 | 1.60 | 0.30 | 0.70 | 1.87 | 0.57 | 0.80 | 2.18 | 239752 | 15617 | 1.14 | Inventive Example |
| 19 | 0.050 | 3.80 | 1.60 | 0.30 | 0.75 | 1.92 | 0.62 | 0.80 | 2.37 | 240643 | 14422 | 1.15 | Inventive Example |
| 20 | 0.050 | 3.80 | 1.60 | 0.30 | 0.80 | 1.97 | 0.67 | 0.80 | 2.56 | 241512 | 13403 | 1.17 | Inventive Example |
| 21 | 0.050 | 3.80 | 1.60 | 0.30 | 0.85 | 2.02 | 0.72 | 0.80 | 2.75 | 93111 | 12523 | 1.16 | Inventive Example |
| 22 | 0.020 | 3.14 | 1.60 | 0.30 | 0.40 | 1.57 | 0.27 | 0.60 | 0.86 | 94773 | 15411 | 1.17 | Inventive Example |
| 23 | 0.020 | 3.14 | 1.60 | 0.30 | 0.60 | 1.77 | 0.47 | 0.60 | 1.49 | 95535 | 9078 | 1.21 | Inventive Example |
| 24 | 0.020 | 3.14 | 1.60 | 0.30 | 0.70 | 1.87 | 0.57 | 0.60 | 1.81 | 96257 | 7559 | 1.22 | Inventive Example |
| 25 | 0.020 | 3.14 | 1.60 | 0.30 | 0.80 | 1.97 | 0.67 | 0.60 | 2.12 | 123551 | 6487 | 1.23 | Inventive Example |
| 26 | 0.027 | 3.14 | 1.60 | 0.30 | 0.35 | 1.52 | 0.22 | 0.60 | 0.71 | 123551 | 24999 | 1.01 | Comparative Example |
| 27 | 0.027 | 3.14 | 1.60 | 0.30 | 0.38 | 1.55 | 0.25 | 0.60 | 0.80 | 123912 | 22119 | 1.03 | Comparative Example |
| 28 | 0.037 | 3.80 | 1.60 | 0.30 | 0.35 | 1.52 | 0.22 | 0.80 | 0.85 | 169882 | 28408 | 0.99 | Comparative Example |
| 29 | 0.037 | 3.80 | 1.60 | 0.30 | 0.40 | 1.57 | 0.27 | 0.80 | 1.04 | 170704 | 23350 | 1.01 | Comparative Example |
| 30 | 0.050 | 3.80 | 1.60 | 0.30 | 0.40 | 1.57 | 0.27 | 0.80 | 1.04 | 232779 | 31841 | 0.97 | Comparative Example |
| 31 | 0.050 | 3.80 | 1.60 | 0.30 | 0.50 | 1.67 | 0.37 | 0.80 | 1.42 | 234918 | 23559 | 0.99 | Comparative Example |
| 32 | 0.020 | 3.14 | 1.60 | 0.30 | 0.70 | 1.87 | 0.57 | 0.80 | 1.81 | 95535 | 7559 | 0.82 | Comparative Example |

INDUSTRIAL APPLICABILITY

The molten steel refining method of the present invention can optimize the circulating rate in an RH vacuum degassing apparatus and thereby efficiently perform vacuum decarburization or vacuum degassing, which makes it useful for industrial purposes.

REFERENCE SIGNS LIST

1 RH vacuum degassing apparatus
2 Ladle
3 Molten steel
4 Slag
5 Vacuum tank
6 Upper tank
7 Lower tank
8 Rising-side immersion tube (rising tube)
9 Descending-side immersion tube (descending tube)
10 Circulating gas blow-in pipe
11 Duct
12 Raw material charging port
13 Top-blowing lance $$H_0=h_V+L-h_G \quad (3)$$

$$h_V=(P_0-P)/(\rho_L g)+1-L \quad (4)$$

$$1.35\times10^5\times D_U/W_V<\varepsilon<2.1\times10^4 \quad (5)$$

where the symbols represent the following:

ε: the stirring power energy density (watt/ton) for the molten steel inside the vacuum tank,
G: the circulating gas flow rate (Nm³/sec),
T: a temperature (K) of the molten steel,
$\rho_L$: a density (kg/m³) of the molten steel,
g: a gravitational acceleration of 9.8 m/sec²,
$W_V$: a mass (ton) of the molten steel inside the vacuum tank,
$D_V$: an inside diameter (m) of the vacuum tank,
$H_0$: a height (m) from a position of a circulating gas blow-in nozzle to a bath surface of the molten steel inside the vacuum tank in a stationary state,
P: a pressure (Pa) inside the vacuum tank,
$P_0$: an atmospheric pressure of 101325 Pa,
$h_V$: a height (m) from the bath surface of the molten steel inside the vacuum tank in the stationary state to a bed, L: a height (m) from a lower end of the immersion tube to the bed, $h_G$: a height (m) from the lower end of the immersion tube to the position of the circulating gas blow-in nozzle, l: the immersion depth (m) of the immersion tube into the molten steel, and $D_U$: an inside diameter (m) of a rising tube, the method comprising:

controlling the stirring power energy density so as to meet Formula (5) by adjusting the immersion depth of the immersion tube or the circulating gas flow rate.

2. The molten steel refining method according to claim 1, wherein the immersion depth l of the immersion tube into the molten steel or the circulating gas flow rate G is determined such that the stirring power energy density ε meets the following Formula (6):

$$1.35\times10^5\times D_U/W_V<\varepsilon<1.0\times10^4 \quad (6).$$

* * * * *